US007703702B2

(12) United States Patent
Strong

(10) Patent No.: US 7,703,702 B2
(45) Date of Patent: Apr. 27, 2010

(54) PNEUMATICALLY OPERATED DEVICE HAVING CHECK VALVE VENT AND METHOD FOR MAKING SAME

(75) Inventor: Christopher L. Strong, Frederick, CO (US)

(73) Assignee: Illinois Tool Works Inc., Glenview, IL (US)

( * ) Notice: Subject to any disclaimer, the term of this patent is extended or adjusted under 35 U.S.C. 154(b) by 1037 days.

(21) Appl. No.: 10/819,845

(22) Filed: Apr. 7, 2004

(65) Prior Publication Data

US 2005/0224609 A1 Oct. 13, 2005

(51) Int. Cl.
*B05B 1/28* (2006.01)

(52) U.S. Cl. ..... 239/296; 239/290; 239/525; 239/569; 137/852; 137/854

(58) Field of Classification Search ..... 239/290–301, 239/569, 525; 137/854
See application file for complete search history.

(56) References Cited

U.S. PATENT DOCUMENTS

| | | | | | |
|---|---|---|---|---|---|
| 2,670,882 | A | * | 3/1954 | Best | 222/464.1 |
| 3,159,176 | A | * | 12/1964 | Russell et al. | 137/493.1 |
| 3,423,939 | A | * | 1/1969 | Lewis et al. | 60/588 |
| 4,084,606 | A | | 4/1978 | Mittleman | |
| 4,100,894 | A | | 7/1978 | Tamura | |
| 4,264,287 | A | | 4/1981 | Ishida et al. | |
| RE30,968 | E | * | 6/1982 | Grant | 222/111 |
| 4,388,997 | A | * | 6/1983 | Grime | 220/203.14 |
| 4,498,299 | A | | 2/1985 | Brademeyer | |
| 4,499,916 | A | | 2/1985 | Hanson et al. | |
| 4,513,784 | A | | 4/1985 | Farrand et al. | |
| 4,527,594 | A | | 7/1985 | Garneau | |
| 4,711,224 | A | | 12/1987 | Eckhardt | |
| 4,758,224 | A | | 7/1988 | Siposs | |
| 4,789,467 | A | | 12/1988 | Lindsay et al. | |
| 5,092,361 | A | | 3/1992 | Masuyama et al. | |
| 5,100,060 | A | * | 3/1992 | Haferkorn | 239/337 |
| 5,129,426 | A | | 7/1992 | Boehmer | |
| 5,190,219 | A | * | 3/1993 | Copp, Jr. | 239/296 |
| 5,203,508 | A | * | 4/1993 | Westenberger | 239/290 |
| 5,226,600 | A | * | 7/1993 | Frank | 239/337 |
| 5,330,108 | A | | 7/1994 | Grime et al. | |
| 5,348,046 | A | | 9/1994 | Kozumplik, Jr. et al. | |
| 5,507,318 | A | | 4/1996 | Israelson | |

(Continued)

FOREIGN PATENT DOCUMENTS

| | | |
|---|---|---|
| DE | 3836051 | 11/1989 |
| EP | 0572237 | 12/1993 |
| EP | 0979683 | 2/2000 |

*Primary Examiner*—Dinh Q Nguyen
(74) *Attorney, Agent, or Firm*—Fletcher Yoder

(57) ABSTRACT

A pneumatically operated device. The pneumatically operated device comprises a movable member disposed within a housing. The movable member is operable to control operation of the device. Pressurized air is directed to a first side of the movable member to drive the movable member in a first direction to operate the device. The pneumatically operated device comprises a check valve disposed through an opening in the housing to enable air to vent from a second side of the movable member. The check valve may comprise a flexible cover extending over the opening and biased against the housing to form a seal.

29 Claims, 6 Drawing Sheets

U.S. PATENT DOCUMENTS 5,667,366 A 9/1997 Reef et al.
5,727,594 A 3/1998 Choksi
5,816,430 A 10/1998 Gruber
5,842,682 A 12/1998 Schennum et al.
5,893,609 A 4/1999 Schmidt
5,974,819 A * 11/1999 Poling et al. ..... 62/263
6,267,302 B1 7/2001 Huffman
6,516,829 B1 * 2/2003 Townsend et al. ..... 137/517

* cited by examiner

PNEUMATICALLY OPERATED DEVICE HAVING CHECK VALVE VENT AND METHOD FOR MAKING SAME

BACKGROUND OF THE INVENTION

The present technique relates generally to pneumatically operated devices. More specifically, a technique is provided to enable a pneumatically operated sprayer to relieve pressure from within the sprayer, while preventing cleaning liquids from entering the sprayer.

Automatic sprayers are used in manufacturing to apply a layer of coating to a work piece. For example, a manufacturer of toilets may use an automatic sprayer to apply a porcelain coating to the toilet bowl. Typically, automatic sprayers are pneumatically operated devices. Pressurized air is supplied to the automatic sprayer, which causes the sprayer to begin spraying. The pressurized air is removed to stop the automatic sprayer from spraying. A typical automatic sprayer has a spray control valve that is coupled to a diaphragm. Pressurized air is applied to one side of the diaphragm to drive the diaphragm in a first direction to unseat the spray control valve, enabling spray material to flow from the sprayer. A spring is provided to shut the flow control valve when the pressurized air is removed. During operation, pressurized air may leak around the diaphragm and cause the pressure across the diaphragm to equalize. When that occurs, the spring will shut the valve and cause the sprayer to inadvertently stop spraying. Consequently, sprayers have been provided with vents to prevent any air that leaks across the diaphragm from building up sufficient pressure within the sprayer to equalize the pressure across the diaphragm.

In addition, the material being sprayed occasionally is deflected back onto the sprayer. In the example of a toilet bowl provided above, the limited space inside the toilet bowl forces the automatic sprayer to be positioned close to the surface of the toilet bowl during spraying. This increases the likelihood that some of the spray material will be deflected back onto the sprayer. Similarly, in multi-sprayer applications, one sprayer may be aligned to spray material on at least a portion of another sprayer. As a result, automatic sprayers may be routinely washed or hosed down to prevent the buildup of spray material on important parts of the sprayer. If the spray material is not removed, it may interfere with the operation of the sprayer and/or produce defects in the coating applied by the sprayer.

However, problems have been experienced with washing down automatic sprayers. The vents that prevent air leaks from inadvertently stopping operation of the sprayer also enable water or other cleaning solutions to enter the sprayer during cleaning. These cleaning liquids may cause the internal components of the sprayer to rust or otherwise lead to failure of the sprayer. Accordingly, a technique is needed to address the foregoing problems.

SUMMARY OF THE INVENTION

A pneumatically operated device. The pneumatically-operated device comprises a movable member disposed within a housing. The movable member is operable to control operation of the device. Pressurized air is directed to a first side of the movable member to drive the movable member in a first direction to operate the device. The pneumatically operated device comprises a check valve disposed through an opening in the housing to enable air to vent from a second side of the movable member. The check valve may comprise a flexible cover extending over the opening and biased against the housing to form a seal.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

As discussed in further detail below, the present technique provides a unique spray device having features that facilitate disassembly, servicing, and repeatable mounting in substantially the same spray position. For example, the spray device of the present technique has various structural features that reduce the likelihood of fluid drainage into undesirable areas of the spray device during disassembly and servicing. The present spray device also has a unique mounting mechanism, which preserves the desired mounting position for the spray device in the event of dismounting and subsequent remounting of the spray device.

Figure 1:
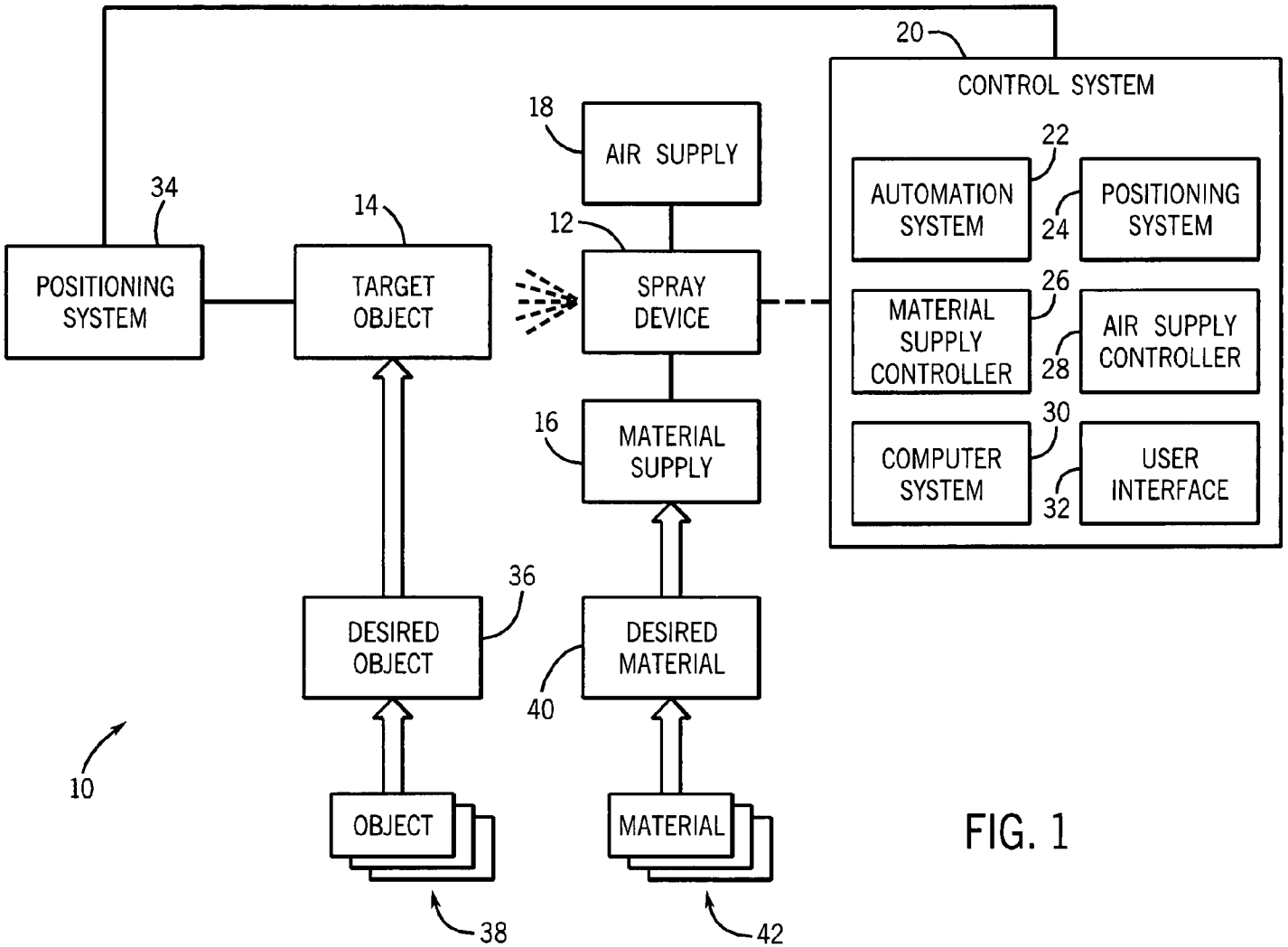
FIG. 1 is a diagram illustrating an exemplary spray system having a spray device in accordance with certain embodiments of the present technique.

Turning now to the figures, FIG. 1 is a flow chart illustrating an exemplary spray system 10, which comprises a spray device 12 for applying a desired material to a target object 14. For example, the spray device 12 may comprise an air atomizer, a rotary atomizer, an electrostatic atomizer, or any other suitable spray formation mechanism. The spray device 12 also may comprise an automatic triggering or on/off mechanism, such as a pressure-activated valve assembly. The spray device 12 may be coupled to a variety of supply and control systems, such as a material supply 16 (e.g., a fluid or powder), an air supply 18, and a control system 20. The control system 20 facilitates control of the material and air supplies 16 and 18 and ensures that the spray device 12 provides an acceptable quality spray coating on the target object 14. For example, the control system 20 may include an automation system 22, a positioning system 24, a material supply controller 26, an air supply controller 28, a computer system 30, and a user interface 32. The control system 20 also may be coupled to a positioning system 34, which facilitates movement of the target object 14 relative to the spray device 12. For example, either one or both of the positioning systems 24 and 34 may comprise an assembly line, a hydraulic lift, a robotic arm, and a variety of other positioning mechanisms controlled by the control system 20. Accordingly, the spray system 10 may provide a computer-controlled spray pattern across the surface of the target object 14.

The spray system 10 of FIG. 1 is applicable to a wide variety of applications, materials, target objects, and types/configurations of the spray device 12. For example, a user may select a desired object 36 from a variety of different objects 38, such as different material and product types. The user also may select a desired material 40 from a plurality of different materials 42, which may include different material types and characteristics for a variety of materials such as metal, wood, stone, concrete, ceramic, fiberglass, glass, living organisms, and so forth. For example, the desired material 40 may comprise paints, stains, and various other coating materials, such as furniture coatings, vehicle coatings, industrial product coatings, and consumer product coatings. By way of further example, the desired material 40 may comprise a porcelain enamel, a ceramic glaze, or another ceramic coating material, which may be applied to toilets, sinks, water heaters, washing machines, dinner plates and bowls, and so forth. The desired material 40 also may comprise insecticides, fungicides, and various other chemical treatments. In addition, the desired material 40 may have a solid form (e.g., a powder), a fluid form, a multi-phase form (e.g., solid and liquid), or any other suitable form.

Figure 2:
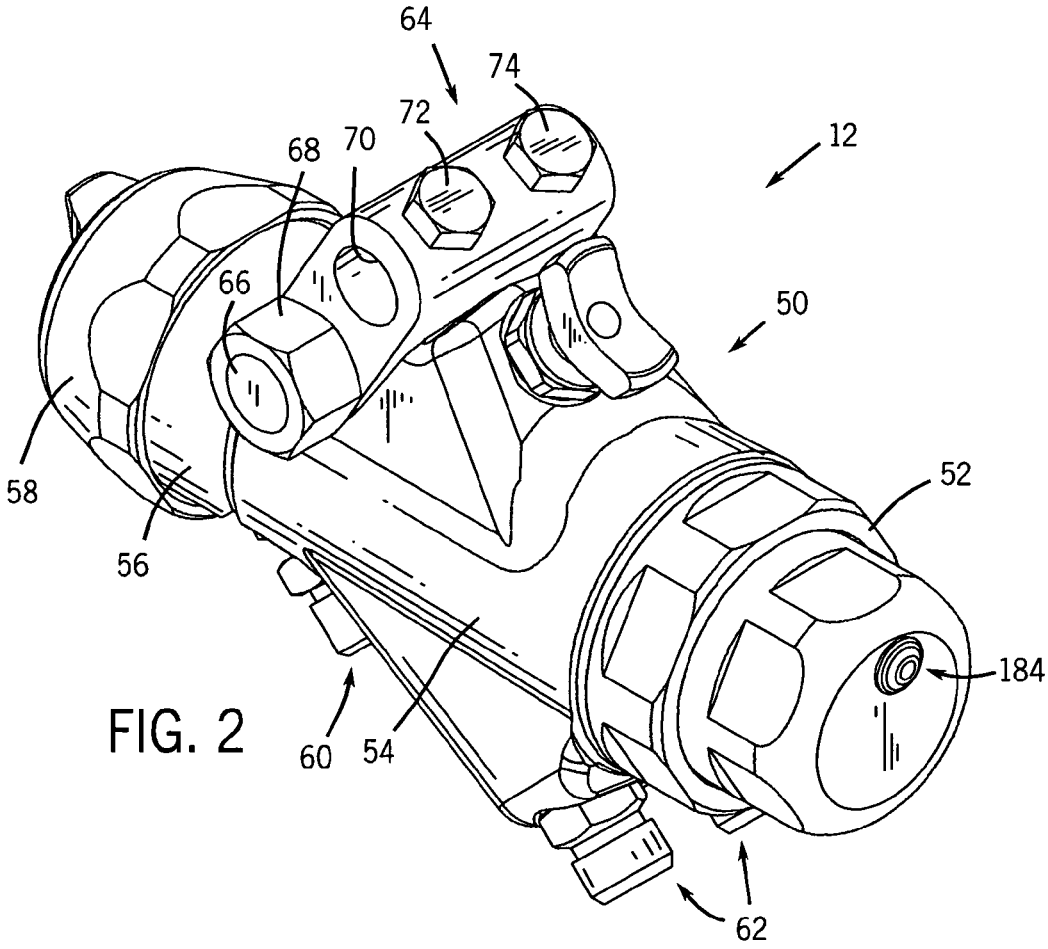
FIG. 2 is a perspective view of an exemplary embodiment of the spray device illustrated in FIG. 1.

FIG. 2 is a perspective view illustrating an exemplary embodiment of the spray device 12. As illustrated, the spray device 12 comprises a body 50 having a base section 52, a mid-section 54 coupled to the base section 52, a head section 56 coupled to the mid-section 54, and a spray formation section 58 coupled to the head section 56. Fluid inlet 60 and air inlet 62 also extend into the body 50, thereby feeding a desired fluid and air into the spray device 12 to form a desired spray via the head and spray formation section 56 and 58. As discussed above, the spray device 12 may comprise any suitable fluid atomizing mechanisms, air valves, fluid valves, spray shaping mechanisms (e.g., air shaping jets or ports), and so forth. The spray device 12 also may be automatically activated or triggered, such as by a pressure-activated valve.

In the illustrated embodiment, the spray device 12 also comprises a releasable mount 64 that is releasably coupled to the body 50 via a fastening mechanism, such as an externally threaded fastener 66 and an internally threaded fastener 68. Other suitable tool-free or tool-based fasteners are also within the scope of the present technique. For example, the releasable mount 64 may be coupled to the body 50 via a latch, a spring-loaded mechanism, a retainer member, a compressive-fit mechanism, an electromechanical latch mechanism, a releasable pin, a releasable joint or hinge, and so forth. The releasable mount 64 also comprises an external mounting mechanism, such as a mounting receptacle 70 and mounting fasteners or set screws 72 and 74 extending into the mounting receptacle 70. As discussed in further detail below, the spray device 12 may be mounted to a desired stationary or movable positioning system by extending a mounting member or rod into the mounting receptacle 70 and securing the releasable mount 64 to the mounting member via the mounting fasteners or set screws 72 and 74. The spray device 12 can be dismounted by either disengaging the mounting fasteners 72 and 74 from the mounting member or by disengaging the fasteners 66 and 68 from the body 50 of the spray device 12. In this exemplary embodiment, the latter approach may be used to preserve the desired mounting position of the releasable mount 64 on the mounting member. Accordingly, if the spray device 12 is removed for maintenance, replacement, or other purposes, then the releasable mount 64 remains attached to the mounting member to ensure that the spray device 12 or its substitute can be reattached in the same or substantially the same mounting position.

Figure 3A:
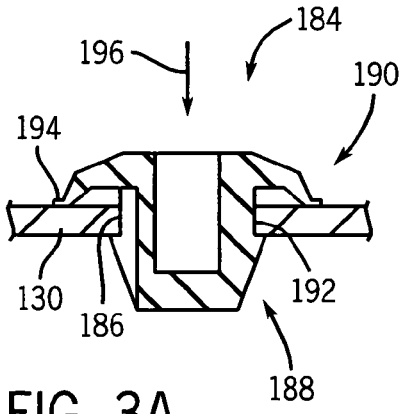
FIG. 3A is a cross-sectional view of a check valve installed in the spray device to reduce pressure from within the spray device, taken generally along line 3A-3A of FIG. 3.
Figure 3B:
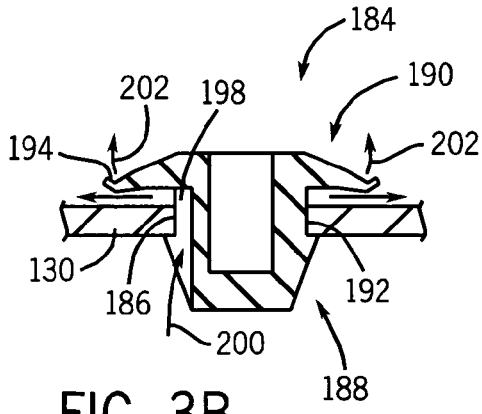
FIG. 3B is a cross-sectional view of the check valve of FIG. 3A, illustrating the operation of the check valve to reduce pressure from within the spray device housing.
Figure 3:
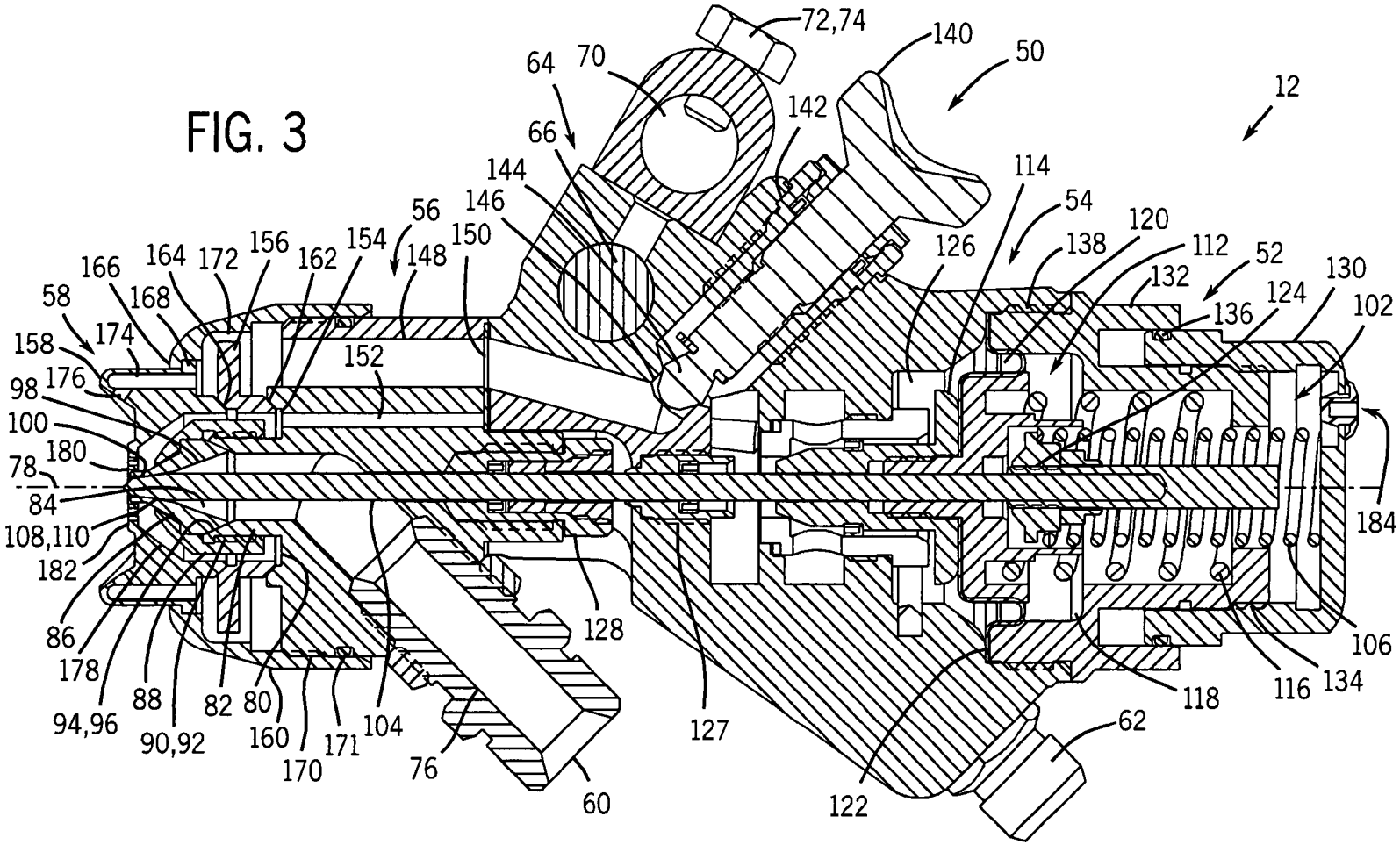
FIG. 3 is a cross-sectional side view illustrating exemplary internal passageways and flow control components of the spray device illustrated in FIG. 2.

Turning now to the internal features, FIG. 3 is a cross-sectional side view of the spray device 12 illustrating exemplary flow passageways, flow control mechanisms, and spray formation mechanisms. As illustrated, a fluid passageway 76 extends angularly into the head section 56 to a longitudinal centerline 78, where the fluid passageway 76 aligns with the longitudinal centerline 78 and continues to a front portion 80 of the head section 56. At the front portion 80, the fluid passageway 76 extends outwardly from the front portion 80 to form a protrusive fluid passageway 82 having a fluid exit 84 that is longitudinally offset from the front portion 80. As illustrated, a fluid nozzle 86 is removably coupled to the protrusive fluid passageway 82 at the fluid exit 84 via a retainer 88, which may comprise an annular structure having internal threads 90 engaged with external threads 92 of the protrusive fluid passageway 82. The illustrated fluid nozzle 86 comprises an inwardly angled inlet surface 94 abutted against an outwardly angled exit surface 96 of the protrusive fluid passageway 82, thereby forming a compressive fit or wedged seal as the retainer 88 is threadably engaged with the protrusive fluid passageway 82. Alternatively, the fluid nozzle 86 may be coupled to the protrusive fluid passageway 82 by a variety of other seal members (e.g., an o-ring), compressive fit mechanisms, threaded engagements, seal materials, and so forth. The fluid nozzle 86 also has a converging inner passageway 98, which extends outwardly from the inwardly angled inlet surface 94 toward an annular fluid exit 100.

It should be noted that the fluid nozzle 86 may comprise a one-piece structure formed via a molding process, a machining process, or any other suitable manufacturing process. However, any other multi-sectional structure and assembly process is within the scope of the present technique. The illustrated fluid nozzle 86 also has a relatively small internal volume defined substantially by the converging inner passageway 98. As discussed in further detail below, the foregoing protrusive fluid passageway 82 and converging inner passageway 98 may provide certain benefits. For example, the passageways 82 and 98 may reduce drainage or spillage of fluids into other portions of the spray device 12 during servicing, maintenance, and other functions in which the fluid nozzle is removed from the protrusive fluid passageway 82.

As illustrated in FIG. 3, the spray device 12 also comprises a fluid valve assembly 102 having a needle or valve member 104 extending through the body 50 from the base 52, through the mid-section 54, through the head section 56, and into the spray formation section 58. In the base section 52, the fluid valves assembly 102 has a valve spring 106, which springably biases the valve member 104 outwardly from the base section 52 toward the spray formation section 58, where a wedged tip 108 of the valve member 104 compressively seals against a corresponding internal portion 110 of the converging inner passageway 98 of the fluid nozzle 86. The fluid valve assembly 102 also comprises a pressure-biasing mechanism or piston assembly 112 to facilitate inward opening of the valve member 104 relative to the fluid nozzle 86. The pressure biasing mechanism or piston assembly 112 comprises a valve piston 114 disposed about the valve member 104, a piston biasing spring 116 disposed in a chamber 118 of the base section 52 around the valve spring 106, and an air diaphragm 120 extending about the valve piston 114 and across the chamber 118 to an abutment edge 122 between the base section 52 and the mid-section 54. Other pressure biasing mechanisms are also within the scope of the present technique. For example, the piston assembly 112 may embody a piston disposed sealingly against an internal wall of a cylinder.

As further illustrated in FIG. 3, the piston biasing spring 116 springably forces the valve piston 114 outwardly from the base section 52 toward the middle section 54. In this outwardly biased position, the valve piston 114 is disengaged from a valve engagement member 124 coupled to the valve member 104. If air is supplied from one of the air inlets 62 to an internal air passageway 126, then the air pressurably biases the air diaphragm 120 and corresponding valve piston 114 with sufficient force to overcome the spring force of the piston biasing spring 116. Accordingly, the valve piston 114 moves inwardly from the mid-section 54 to the base section 52. As the air pressure forces the valve piston 114 inwardly against the valve engagement member 124, the air pressure further overcomes the spring force of the valve spring 106. Accordingly, the valve piston 114 pressurably biases the valve engagement member 124 and corresponding valve vendor member 104 inwardly from the mid-section 54 into the base section 52, thereby moving the valve member 104 and corresponding wedged tip 108 inwardly away from the internal portion 110 of the fluid nozzle 86 to an open position. Although illustrated as an inwardly opening valve, the valve assembly 102 may comprise an outwardly opening valve, an independent internal valve, an independent external valve, or any other suitable valve configuration. Moreover, the valve assembly 102 may comprise any suitable manual or automatic valve mechanism, such as a piston-cylinder assembly, an electromechanical valve mechanism, a magnetically activated valve, and so forth.

The various sections, internal passageways, and structures of the spray device 12 are intercoupled and sealed via threads, seals, o-rings, gaskets, compressive fit mechanisms, packing assemblies, and so forth. For example, as illustrated in FIG. 3, the spray device 12 comprises an air packing assembly 127 and a fluid packing assembly 128 disposed about the valve member 104 between the internal air passageway 126 and the fluid passageway 76. In addition, the base section 52 comprises an outer annular structure or cap 130 threadably coupled and sealed to an inner annular structure 132 via threads 134 and o-ring or seal member 136, respectively. The inner annular structure 132 is threadably coupled and sealed to the mid-section 54 via threads 138 and a portion of the air diaphragm 120 disposed within the abutment edge 122 between the base section 52 and the mid section 54. Additional seals also may be provided within the scope of the present technique.

In the mid-section 54, the spray device 12 also comprises an air flow control mechanism 140, which is mounted in a receptacle 142 extending angularly into the mid-section 54. As illustrated, the flow control mechanism 140 comprises a protruding valve member 144, which releasably seals against an annular opening 146 extending into an air passageway 148 between air passageways 126 and 148. Accordingly, the flow control mechanism 140 provides control over the airflow into the head section 56 and the spray formation section 58 via the air passageway 148. The illustrated spray device 12 also has a gasket 150 disposed between the mid-section 54 and the head section 56, thereby creating an airtight seal between the two sections and about the air passageways extending between the two sections. Additional seals also may be provided within the scope of the present technique.

The head section 56 also comprises an air passageway 152 extending from the mid-section 54 to the front portion 80, such that an air exit 154 of the air passageway 152 is longitudinally offset from the fluid exit 84 of the protrusive fluid passageway 82. In the event that the fluid nozzle 86 is removed from the protrusive fluid passageway 82, the foregoing longitudinal offset distance between the fluid and air exits 84 and 154 substantially reduces or eliminates the fluid drainage or spillage into the air passageway 152 and other portions of the spray device 12.

Turning now to the spray formation section 58, various flow passageways and flow enhancing structures are illustrated with reference to FIG. 3. As illustrated, the spray formation section 58 comprises an internal air deflector ring 156, a front air cap 158 disposed adjacent the internal air deflector ring 156, and an external retainer ring 160 removably coupled to the head section 56 and disposed about the internal air deflector ring 156 and the front air cap 158. The internal air deflector ring 156 is sealed against the front portion 80 of the head section 56 via a compressive fit or wedged interface 162. Similarly, the front air cap 158 is sealed against the internal air deflector ring 156 via a compressive fit or wedged interface 164. Finally, the external retainer ring 160 comprises an inward lip 166 that catches and seals against an outward lip 168 of the front air cap 158. As the external retainer ring 160 is threadably secured to the head section 56 via threads 170, the external retainer ring 160 compresses the front air cap 158, the internal air deflector ring 156, and the head section 56 toward one another to create a compressive or wedged seal at each of the wedged interfaces 162 and 164. As illustrated, a seal member or o-ring 171 also may be provided between the external retainer ring 160 and the head section 56 adjacent the threads 170.

In assembly, the various components of the spray formation section 58 also define various passageways to facilitate atomization of the fluid exiting from the fluid nozzle 86. As illustrated, the internal air deflector ring 156, the front air cap 158, and the external retainer ring 160 collectively define a U-shaped or curved air passageway 172, which extends from the air passageway 148 in the head section 56 to air cap passageways 174 in the front air cap 158. The air cap passageways 174 further extend into air shaping ports or jets 176, which are directed inwardly toward the centerline 78 to facilitate a desired spray shape. The internal air deflector ring 156 and the front air cap 158 also define an interior air passageway 178 about the protrusive fluid passageway 82, the fluid nozzle 86, and the retainer 88. As illustrated, the interior air passageway 178 extends from the air passageway 152 in the head section 56 to a plurality of air atomizing ports or jets 180 in a front section 182 of the front air cap 158. These air atomizing ports or jets 180 are disposed about the annular fluid exit 100 of the fluid nozzle 86, such that the air atomizing ports or jets 180 facilitate atomization of the fluid exiting from the fluid nozzle 86. Again, as the spray device 12 creates a fluid spray, the air shaping ports or jets 176 facilitate a desired spray shape or pattern, such as a flat spray, a wide conical spray pattern, a narrow conical spray pattern, and so forth.

In addition, the spray device 12 is provided with a check valve 184 to enable the cap 130 of the spray device 12 to be vented to the atmosphere. The check valve 184 prevents pressurized air that leaks across the diaphragm 120 or between the valve engagement member 124 and the valve member 104 from building up pressure in the cap 130, which might lead to the pressure being equalized across the diaphragm 120. In addition, the check valve 184 is designed to prevent any cleaning liquids or solutions from entering the spray device 12 through the check valve 184.

Referring generally to FIGS. 3A and 3B, the illustrated check valve 184 is a one-piece check valve composed of a flexible material, such as an elastomeric material or a polymer, that extends through a hole 186 in the cap 130 of the spray device 12. In this embodiment, the check valve 184 is an umbrella-type check valve. The umbrella-type check valve 184 is inserted into a hole 186 in the cap 130. The check valve 184 is held in place in the hole 186 by a flanged portion 188 that is located within the cap 130 and a bell-shaped portion 190 that is located on the outside of the cap 130. The check valve 184 also has a stem 192 that connects the bell-shaped outer portion 190 to the flanged portion 188 located in the interior of the cap 130.

The bell-shaped portion 190 of the check valve 184 has a flexible lip 194 that forms a seal between the check valve 184 and the cap 130. The lip 194 of the check valve 184 prevents a cleaning liquid 196 from entering the cap 130 through the hole 186. As illustrated in FIG. 3B, the stem 192 of the check valve 184 has at least one slot 198 that enables air 200 that has leaked past the valve piston 114 and diaphragm 120 into the cap 130 to enter the bell-shaped portion 190 of the check valve 184. As air pressure builds in the cap 130, the air pressure produces a force to urge the lip 194 outward. At a certain pressure, the force is sufficient to flex the lip 194 outward away from the cap 130, as represented by the arrows 202. With the lip 194 unsealed from the cap 130, the pressurized air 200 within the cap 130 is free to vent to the atmosphere, reducing the pressure within the cap 130. The lip 194 is biased to return to its original sealing position against the cap 130. During venting, the air pressure will eventually lower to the point that the biasing force of the lip 194 is greater than the force produced by air pressure within the bell-shaped portion 190 of the check valve 184. This will cause the lip 194 to return to its original sealing position against the cap 130.

Figure 4:
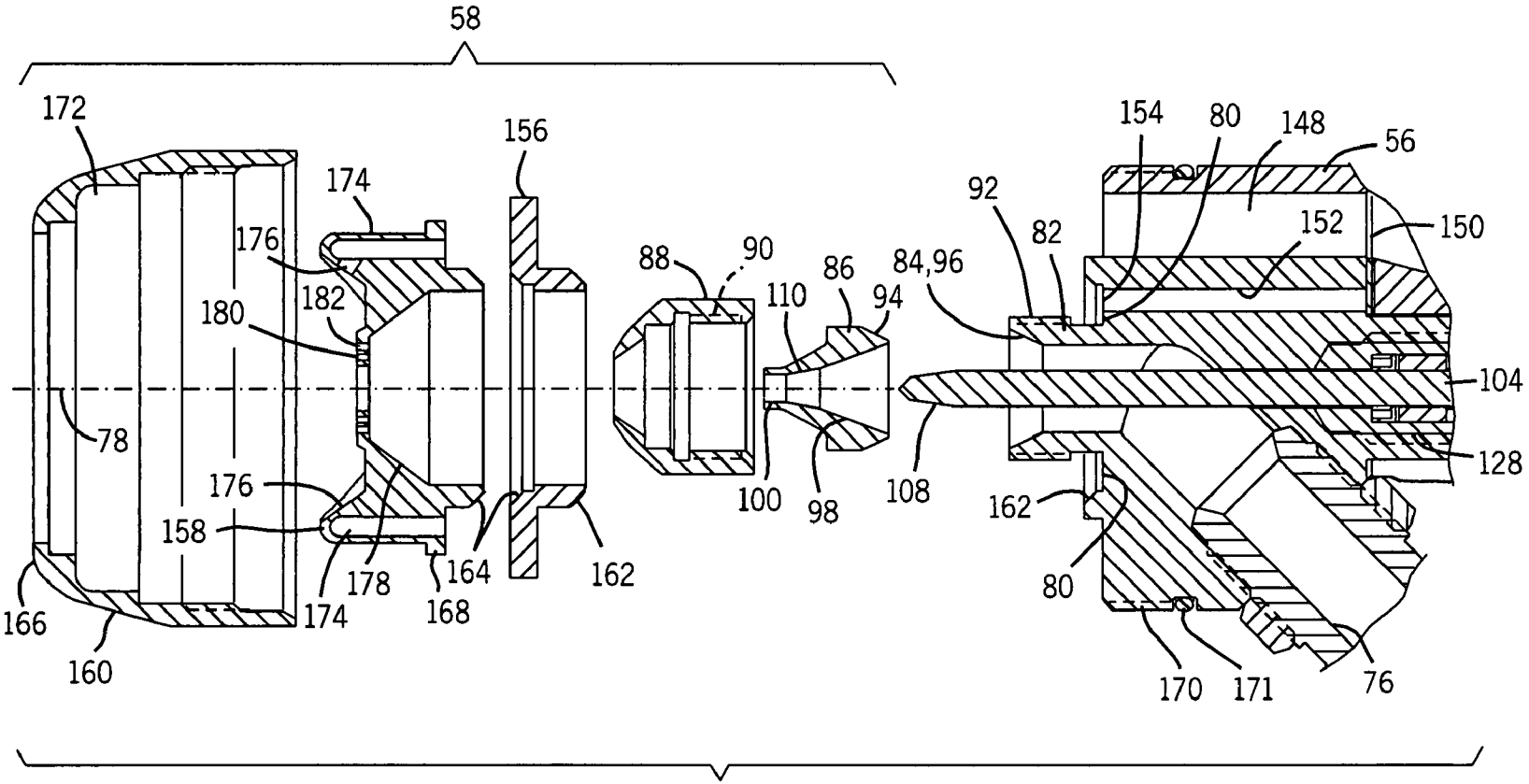
FIG. 4 is a partial cross-sectional side view illustrating an exemplary spray formation section of the spray device illustrated in FIGS. 2 and 3.

FIG. 4 is an exploded cross-sectional side view of the head and spray formation sections 56 and 58 illustrating exemplary features of the spray device 12 of the present technique. It is expected that the spray device 12 may undergo cleaning, servicing, maintenance, part replacements, and other functions in which the spray formation section 58 is removed from the head section 56, as illustrated in FIG. 4. For example, after operation of the spray device 12, the spray formation section 58 may be removed to facilitate cleaning of the fluid nozzle 86 and other internal passageways of the spray device 12. In contrast to previous designs, the foregoing and other functions may be performed more expeditiously and cleanly by way out of the protrusive fluid passageway 82, the segregation of the fluid and air exits 84 and 154, and the relatively small internal volume of the fluid nozzle 86. For example, if the fluid passageway 76 and the fluid nozzle 86 contain residual fluids following use of the spray device 12, then the protrusive fluid passageway 82 and the segregation of the fluid and air exits 84 and 154 prevent drainage or spillage of fluids into the air passageway 152 during removal of the fluid nozzle 86 from the head section 56. Moreover, the relatively small internal volume of the fluid nozzle 86 defined by the converging air passageway 98 also substantially reduces the amount of fluids that drain from the fluid nozzle 86 during its removal from the head section 56. The fluid nozzle 86 of the present technique can also be cleaned more expeditiously than previous designs, because the fluid nozzle 86 has a smaller internal surface area and a shallower depth. For the same reasons, the fluid nozzle 86 of the present technique may be manufactured and replaced at a relatively lower cost than previous designs.

Figure 5:
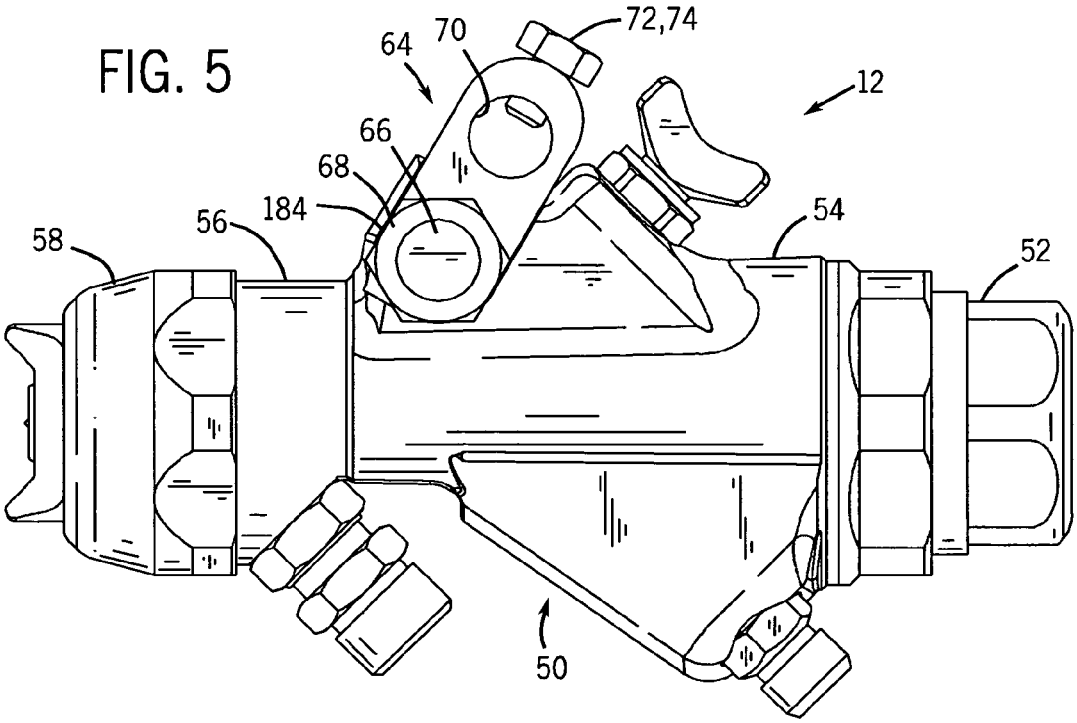
FIG. 5 is a side view illustrating an exemplary releasable mount of the spray device illustrated in FIG. 1.

Turning now to FIG. 5, a side view of the spray device 12 is provided for better illustration of the releasable mount 64. The releasable mount 64 is removably coupled to an upper portion 204 of the body 50 via the externally and internally threaded fasteners 66 and 68. However, any other suitable tool-free or tool-based fasteners may be used within the scope of the present technique. As illustrated, the mounting fasteners or set screws 72 and 74 are threadable into the mounting receptacle 70, such that the releasable mount 64 can be releasably coupled to a desired stationary or mobile device. It should be noted that one or both ends of the releasable mount 64, i.e., at fastener 66 and mounting receptacle 70, may be rotatable or pivotal, such that the spray device 12 can be rotated to a desired orientation. In the illustrated embodiment, the tightness of the fasteners 72 and 74 controls the rotatability of the spray device 12. If the mounting fasteners or set screws 72 and 74 tightly engage the desired stationary or mobile device, then the spray device 12 may not be rotatable about the desired stationary or mobile device.

Figure 6:
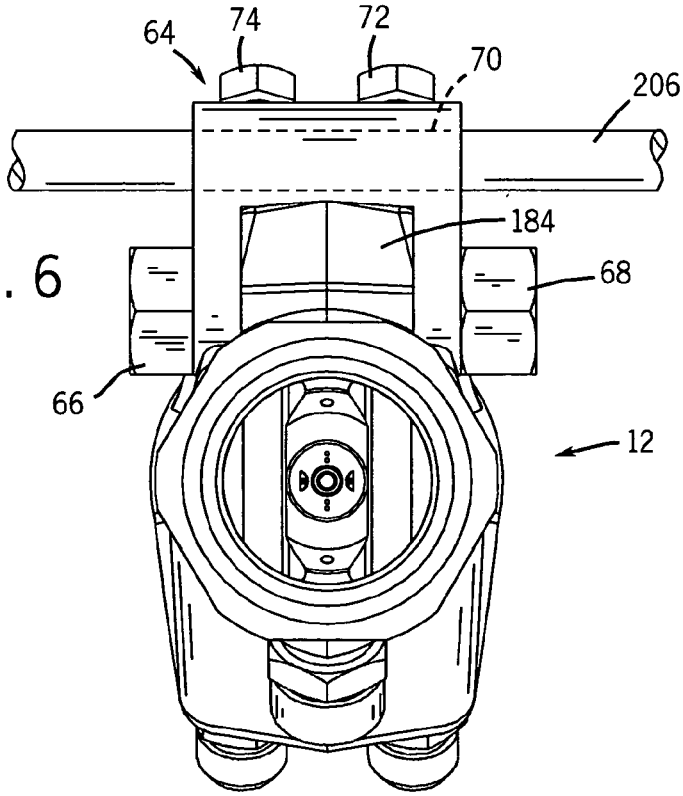
FIG. 6 is a front view illustrating the spray device mounted to a mounting member via the releasable mount illustrated in FIG. 5.

FIG. 6 is a front view of the spray device 12 releasably coupled to a mounting member or rod 206 of such a stationary or mobile device. For example, the mounting member or rod 206 may extend from a robotic arm, an assembly line, a fixed positioning structure, a fixed rod or member, a rail mechanism, a cable and pulley assembly, a hydraulic assembly, a movable positioning structure, or any other suitable structure. Referring back to FIG. 1, the mounting member or rod 206 may be an integral portion of the positioning system 24. The spray device 12 may be mounted to the mounting member or rod 206 by receiving the mounting member or rod 206 into the mounting receptacle 70, adjusting the spray device 12 to the desired spraying position, and then securing the desired position by threading the mounting fasteners or set screws 72 and 74 into the mounting receptacle 70 to contact the mounting member or rod 206.

Figure 7:
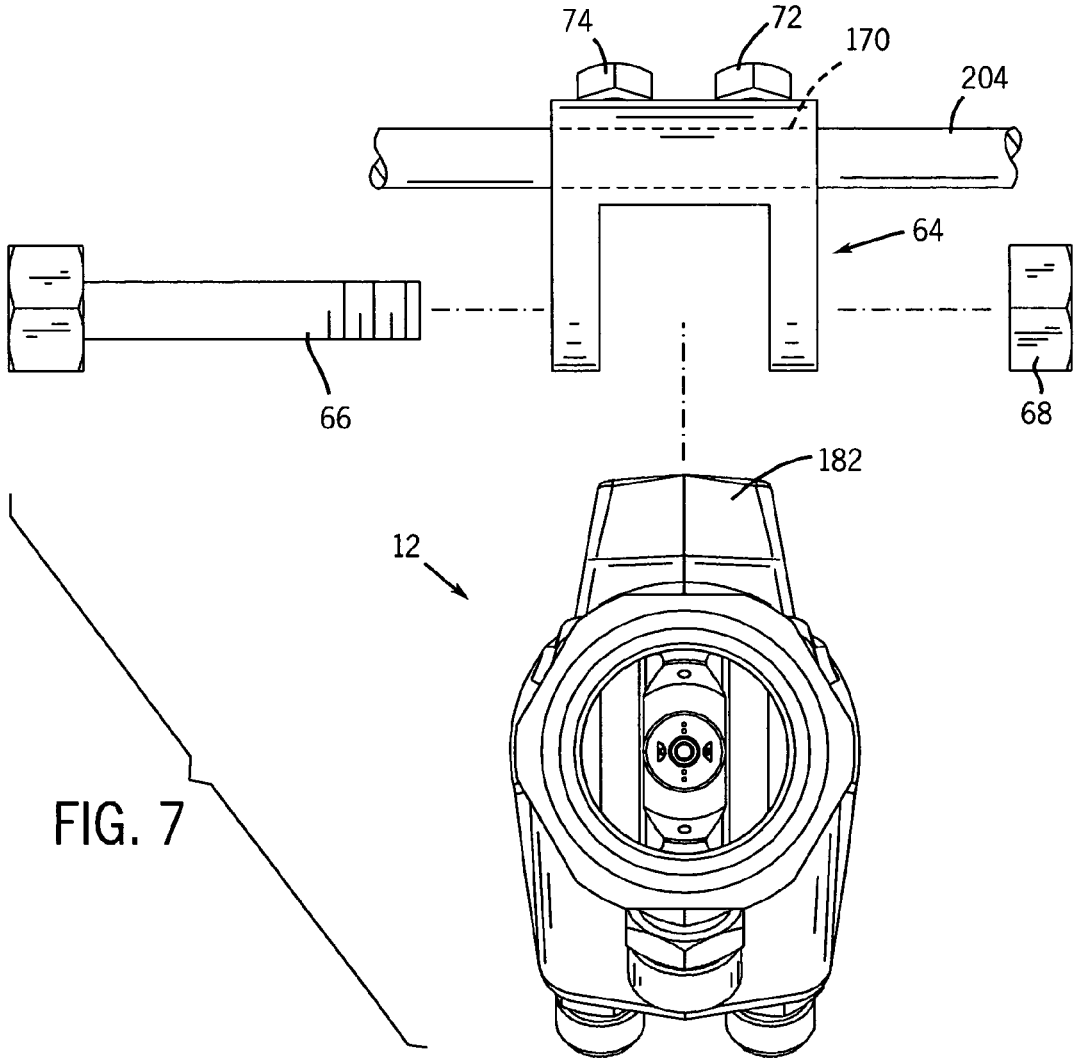
FIG. 7 is an exploded front view illustrating the spray device dismounted from the mounting member of FIG. 6.

The spray device 12 can be dismounted by either disengaging the mounting fasteners 72 and 74 from the mounting member or rod 206 or by disengaging the fasteners 66 and 68 from the body 50 of the spray device 12. FIG. 7 is a front view of the spray device 12 exploded from the releasable mount 64. As illustrated, the releasable mount 64 is preserved in its mounting position on the mounting member or rod 206, such that the spray device 12 or its substitute may be returned to the original mounting position. For example, the spray device 12 may be removed for servicing, cleaning, maintenance, parts replacement, or other purposes. Given the sensitivity of spray processes to positioning of the spray device, the releasable mount 64 of the present technique facilitates repeatable positioning, repeatable spray patterns, and repeatable spray results for the spray device 12 and the system 10. Again, other releasable mounting mechanisms are within the scope of the present technique.

The techniques described above provide a pneumatically operated spray device 12 that has a check valve vent 184 that prevents leaked air from inadvertently stopping operation of the sprayer 12. In addition, the umbrella-type check valve vent 184 prevents cleaning liquids from entering the spray device 12. Although illustrated in an automatic sprayer, the umbrella-type check valve vent 184 may be used in other pneumatically controlled devices to prevent leaked air from stopping operation of the device, while enabling the device to be washed or hosed down.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A spray device, comprising:

a housing assembly;

a pneumatically operated spray control system disposed within the housing assembly and operable to control liquid flow though the spray device, wherein the pneumatically operated spray control system comprises a chamber, a piston movable in the chamber, a spring disposed on a first side of the piston and configured to bias the piston in a first direction, and an air passage leading to a second side of the piston and configured to selectively provide air pressure to bias the piston in a second direction opposite from the first direction, wherein the piston is coupled to a valve member leading to a spray formation section of the spray device; and an umbrella-type check valve disposed through an opening in the housing assembly, wherein the umbrella-type check valve is coupled to an outer wall of the chamber of the housing assembly, wherein the umbrella-type check valve has only a one-way direction of flow out of the housing assembly to enable air to vent from within the housing assembly and to block external liquid from entering the housing assembly, and the umbrella-type check valve is configured to enable the air to vent in response to operation of the pneumatically operated spray control system to control the liquid flow.

2. The spray device of claim 1, wherein the housing assembly comprises a body and a cap secured to the body, the umbrella-type check valve being disposed though an opening in the cap.

3. The spray device of claim 1, wherein the umbrella-type check valve comprises a flexible bell-shaped portion that is biased to form a seal against the outer wall, the flexible bell-shaped portion being flexible to enable pressurized air from within the chamber to unseat the flexible bell-shaped portion from the outer wall and escape chamber.

4. The spray device of claim 3, wherein the umbrella-type check valve comprises a flanged portion that captures the outer wall between the flanged portion and the flexible bell-shaped portion.

5. The spray device of claim 4, wherein the umbrella-type check valve comprises a stem that couples the flanged portion to the flexible bell-shaped portion, the stem having a slot to enable air to flow from the chamber to the flexible bell-shaped portion.

6. The spray device of claim 1, wherein the umbrella-type check valve comprises a stem extending through the opening, and the stem comprises an air channel configured to enable the air to vent from chamber.

7. The spray device of claim 6, comprising a bell-shaped portion coupled to the stem, wherein the bell-shaped portion is disposed on an exterior of the outer wall.

8. The spray device of claim 1, wherein the umbrella-type check valve is configured to vent a pneumatic leak across a sealed portion of the pneumatically operated spray control system.

9. The spray device of claim 1, wherein the valve member is configured to open and close a liquid flow path to a liquid spray exit.

10. The spray device of claim 1, wherein the spray formation section comprises a liquid nozzle having a liquid spray exit and a valve abutment surface, the valve member is configured to move toward the valve abutment surface to reduce liquid flow to the liquid spray exit, and the valve member is configured to move away from the valve abutment surface to increase liquid flow to the liquid spray exit.

11. The spray device of claim 10, wherein the spray formation section comprises an passage leading to an air shaping port, an air atomization port, or a combination thereof.

12. The spray device of claim 1, wherein the pneumatically operated spray control system comprises a diaphragm between the outer wall and the piston.

13. A spray device, comprising:

a spray head comprising a liquid spray outlet;

a pneumatically operated spray control system, comprising:

a wall disposed about a chamber;

a piston movable in the chamber;

a valve member coupled to the piston, wherein the valve member is configured to adjust flow of a liquid to the liquid spray outlet, and the valve member extends into the spray head; and an air passage leading to the chamber to bias the piston between first and second positions; and an umbrella-type check valve coupled to the wall of the pneumatically operated spray control system, wherein the umbrella-type check valve has only a one-way direction of flow out of the chamber in response to movement of the piston.

14. The spray device of claim 13, comprising a spring disposed against the piston.

15. The spray device of claim 13, comprising a diaphragm disposed between the piston and the wall.

16. The spray device of claim 13, wherein the spray head comprises a liquid nozzle having a liquid passage leading to the liquid spray outlet, and the valve member opens and closes against the liquid nozzle.

17. The spray device of claim 16, wherein the valve members extends into the liquid nozzle in a concentric arrangement with the liquid nozzle.

18. The spray device of claim 13, wherein the spray head comprises an air passage leading to an air shaping port, an air atomization port, or a combination thereof.

19. The spray device of claim 13, wherein the wall comprises an annular wall having an axial end wall, and the umbrella-type check valve is coupled to the axial end wall.

20. The spray device of claim 13, wherein the valve member closes flow of the liquid to the liquid spray outlet in the first position of the piston, the valve member opens flow of the liquid to the liquid spray outlet in the second position of the piston, and the air passage routes air to the chamber to bias the piston from the first position toward the second position.

21. The spray device of claim 13, wherein the an umbrella-type check valve comprises a stem, a bell-shaped portion disposed at a first end of the stem, and a flange portion disposed at a second end of the stem, wherein the stem extends though an opening in the wall.

22. The spray device of claim 21, wherein the bell-shaped portion is disposed against an exterior surface of the wall, the flange portion is disposed against an interior surface of the wall, and the stem comprises an exterior slot disposed against the opening from the interior surface to the exterior surface.

23. A spray device, comprising:

a liquid spray nozzle;

a pneumatically operated spray control system, comprising:

a wall disposed about a chamber;

a piston movable in the chamber;

a valve member coupled to the piston, wherein the valve member is configured to adjust flow of a liquid to the liquid spray nozzle, and the valve member extends into the liquid spray nozzle;

a spring biasing the piston in a first direction toward a first position;

an air passage leading to the chamber to bias the piston in a second direction toward a second position, wherein the second direction is opposite from the first direction; and an umbrella-type check valve coupled to the wall of the pneumatically operated spray control system, wherein the umbrella-type check valve has only a one-way direction of flow out of the chamber in response to movement of the piston.

24. The spray device of claim 23, wherein the valve member opens and closes against the liquid spray nozzle.

25. The spray device of claim 23, comprising an air passage leading to an air shaping port, an air atomization port, or a combination thereof.

26. The spray device of claim 23, wherein the wall comprises an annular wall having an axial end wall, and the umbrella-type check valve is coupled to the axial end wall.

27. The spray device of claim 23, wherein the valve member closes flow of the liquid to the liquid spray nozzle in the first position of the piston, and the valve member opens flow of the liquid to the liquid spray nozzle in the second position of the piston.

28. The spray device of claim 23, wherein the an umbrella-type check valve comprises a stem, a bell-shaped portion disposed at a first end of the stem, and a flange portion disposed at a second end of the stem, wherein the stem extends though an opening in the wall.

29. The spray device of claim 28, wherein the bell-shaped portion is disposed against an exterior surface of the wall, the flange portion is disposed against an interior surface of the wall, and the stem comprises an exterior slot disposed against the opening from the interior surface to the exterior surface.

* * * * *